US007362347B2

(12) United States Patent
Okamoto et al.

(10) Patent No.: US 7,362,347 B2
(45) Date of Patent: Apr. 22, 2008

(54) IMAGE RECORDING APPARATUS HAVING A RECORDING DRUM ROTATABLE WITH A RECORDING MEDIUM MOUNTED PERIPHERALLY THEREOF

(75) Inventors: Hiroshi Okamoto, Kyoto (JP); Yoshitomo Wada, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 199 days.

(21) Appl. No.: 11/115,295

(22) Filed: Apr. 27, 2005

(65) Prior Publication Data

US 2005/0248650 A1 Nov. 10, 2005

(30) Foreign Application Priority Data

Apr. 27, 2004 (JP) ..... 2004-131469

(51) Int. Cl.
*B41J 2/435* (2006.01)
*B41J 2/47* (2006.01)

(52) U.S. Cl. ..... 347/234; 347/248

(58) Field of Classification Search ..... 347/234–235, 347/248–250, 262, 264, 116, 229; 101/415.1; 377/17; 358/296; 400/645.3
See application file for complete search history.

(56) References Cited

U.S. PATENT DOCUMENTS 4,325,086 A * 4/1982 Sato et al. ..... 358/296
4,881,248 A * 11/1989 Korechika ..... 377/17
5,448,079 A 9/1995 Schulz
6,604,465 B2 * 8/2003 Tice et al. ..... 101/415.1
6,705,786 B2 * 3/2004 Trovinger ..... 400/645.3
2002/0011164 A1 1/2002 Tice et al.
2003/0075696 A1 4/2003 Kiermeier et al.
2003/0209680 A1 11/2003 Burkatovsky

FOREIGN PATENT DOCUMENTS

EP 1 081 458 A2 3/2001
JP 60019168 A * 1/1985
JP 2001-075292 A 3/2001
JP 2003-337429 A 11/2003

OTHER PUBLICATIONS

European Search Report issued in Application No. 05008287.4 dated Sep. 30, 2005.

* cited by examiner

*Primary Examiner*—Hai Pham
(74) *Attorney, Agent, or Firm*—McDermott Will & Emery LLP

(57) ABSTRACT

An image recording apparatus includes a recording drum rotatable with a printing plate mounted peripherally thereof, a recording head for recording an image on the printing plate mounted on the recording drum, a rotary encoder for detecting a rotation angle of the recording drum, a first and a second sensors for detecting the printing plate mounted on the recording drum, a detection range setting circuit for setting a range of detection of the first and second sensors with respect to the rotation angle of the recording drum according to information on the material of the printing plate, information on reflectance of the printing plate and the presence or absence and the type of positioning holes formed in the printing plate, and a determining circuit for determining a position of an edge of the printing plate mounted on the recording drum, by fetching signals from the first and second sensors based on the rotation angle of the recording drum and the range of detection set by the detection range setting circuit.

18 Claims, 8 Drawing Sheets

IMAGE RECORDING APPARATUS HAVING A RECORDING DRUM ROTATABLE WITH A RECORDING MEDIUM MOUNTED PERIPHERALLY THEREOF

BACKGROUND OF THE INVENTION

1. Field of the Invention

This invention relates to an image recording apparatus having a recording drum rotatable with a recording medium mounted peripherally thereof, and a recording head for recording images on the recording medium mounted on the recording drum.

2. Description of the Related Art

Such an image recording apparatus, generally, employs a construction to position and mount a recording medium such as a printing plate on the peripheral surface of the recording drum by using positioning pins and clamps (see Japanese Unexamined Patent Publication No. 2001-75292, for example). In order to check whether the recording medium such as a printing plate is positioned accurately on the peripheral surface of the recording drum, the image recording apparatus detects an edge of the recording medium by means of sensors arranged in positions opposed to the recording drum.

The position of an edge of the recording medium on the peripheral surface of the recording drum is variable with the material and reflectance of the recording medium or the presence or absence or the type of positioning holes formed in the recording medium. Thus, the edge of the recording medium cannot be detected unless the active range of the sensors is enlarged to acquire edge detection signals from the recording medium over a relatively large range. However, the sensors tend to malfunction when edge detection signals are acquired from a large range.

As noted above, the position of the edge of the recording medium on the peripheral surface of the recording drum is variable with the material and reflectance of the recording medium or the presence or absence or the type of positioning holes formed in the recording medium. Consequently, even when the edge of recording medium is placed in a correct position, the edge could be determined improperly positioned.

SUMMARY OF THE INVENTION

The object of this invention, therefore, is to provide an image recording apparatus capable of detecting an edge of a recording medium accurately without malfunctions.

The above object is fulfilled, according to this invention, by an image recording apparatus comprising a recording drum rotatable with a recording medium mounted peripherally thereof, a recording head for recording an image on the recording medium mounted on the recording drum by emitting light beams according to image signals to the recording medium; a rotation angle detecting device for detecting a rotation angle of the recording drum, a sensor device for detecting the recording medium mounted on the recording drum; a detection range setting device for setting a range of detection of the sensor device with respect to the rotation angle of the recording drum, by using at least one of information on the recording medium and a recording resolution of the image recorded by the recording head; and a determining device for determining a position of an edge of the recording medium mounted on the recording drum, by fetching signals from the sensor device based on the rotation angle of the recording drum detected by the rotation angle detecting device and the range of detection set by the detection range setting device.

With this image recording apparatus, the position of the edge of the recording medium mounted on the recording drum is determined by fetching signals from the sensor device based on the rotation angle of the recording drum detected by the rotation angle detecting device and the range of detection set by the detection range setting device. Consequently, the edge of the recording medium is detected accurately without malfunctions.

In a preferred embodiment, the sensor device includes a plurality of sensors arranged in positions spaced apart axially of the recording drum.

An error handling process may be carried out when it is determined from a result of determination by the determining device that the recording medium is mounted in an improper position.

In another preferred embodiment, the information on the recording medium includes at least one of information on a material of the recording medium, information on reflectance of the recording medium, and presence or absence and a type of positioning holes formed in the recording medium.

In another aspect of the invention, an image recording apparatus comprises a recording drum rotatable with a recording medium mounted peripherally thereof; a recording head for recording an image on the recording medium mounted on the recording drum by emitting light beams according to image signals to the recording medium; a rotation angle detecting device for detecting a rotation angle of the recording drum; a sensor device for detecting the recording medium mounted on the recording drum; an estimated position setting device for setting an estimated position in which the edge of the recording medium is likely to be detected, with respect to the rotation angle of the recording drum, by using at least one of information on the recording medium and a recording resolution of the image recorded by the recording head; and a control circuit for determining whether the recording medium is mounted in a proper position on the recording drum, based on a position of the edge of the recording medium detected from signals of the sensor device and the estimated position of the edge of the recording medium set by the estimated position setting device.

In a further aspect of the invention an image recording apparatus comprises a recording drum for supporting a recording medium; a recording head for recording an image on the recording medium mounted on the recording drum by emitting light beams according to image signals to the recording medium; a sensor device for detecting the recording medium mounted on the recording drum; a sensor moving device for moving the sensor device transversely of the recording medium on the recording drum; a movement detecting device for detecting an amount of movement of the sensor moving device; a detection range setting device for setting a range of detection of the sensor device with respect to a position of the sensor device moved by the sensor moving device, by using at least one of information on the recording medium and a recording resolution of the image recorded by the recording head; and a determining device for determining a position of an edge of the recording medium mounted on the recording drum, by fetching signals from the sensor device based on the position of the sensor device detected by the movement detecting device and the range of detection set by the detection range setting device.

Other features and advantages of the invention will be apparent from the following detailed description of the embodiments of the invention.

BRIEF DESCRIPTION OF THE DRAWINGS

For the purpose of illustrating the invention, there are shown in the image recordings several forms which are presently preferred, it being understood, however, that the invention is not limited to the precise arrangement and instrumentalities shown.

DESCRIPTION OF THE PREFERRED EMBODIMENTS

Figure 1:
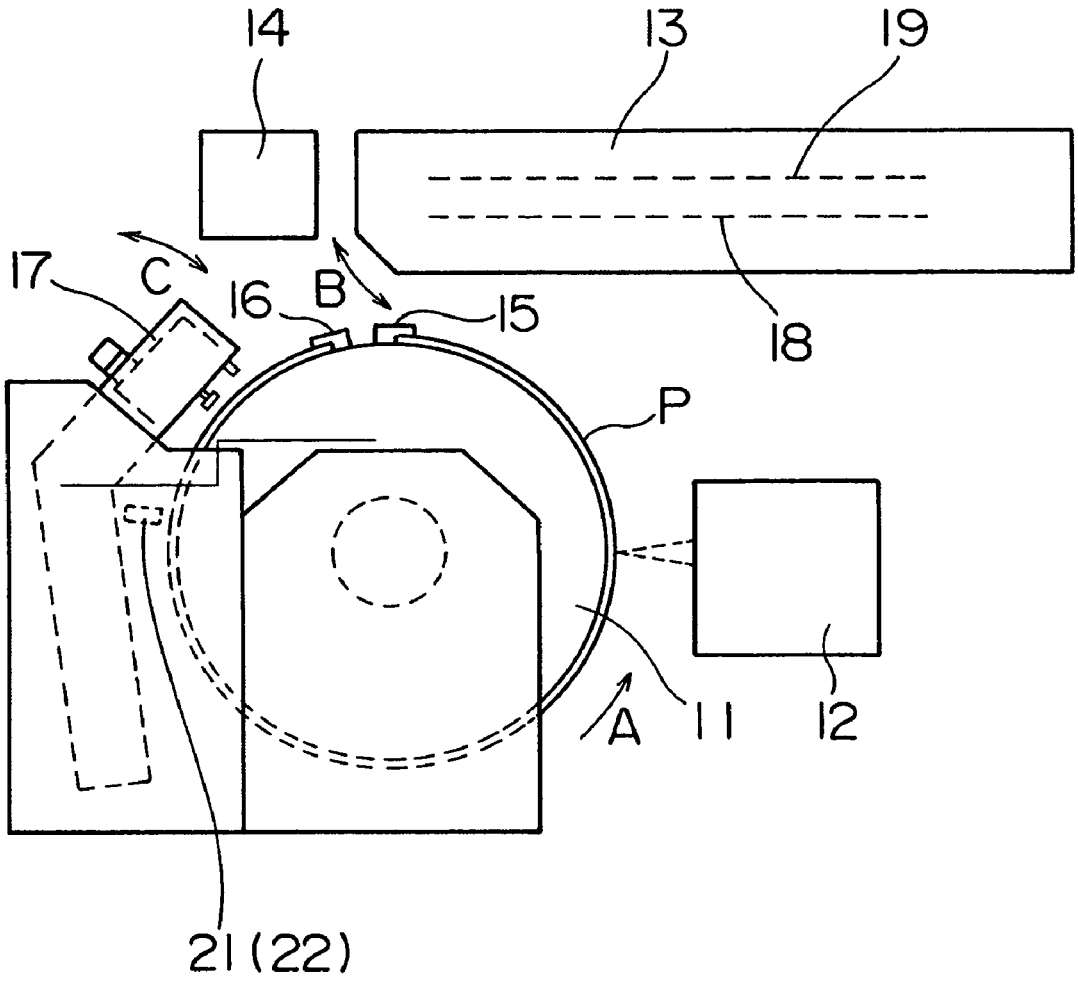
FIG. 1 is a schematic side view of an image recording apparatus according to this invention.

An embodiment of this invention will be described hereinafter with reference to the drawings. FIG. 1 is a schematic side view of an image recording apparatus according to this invention.

The image recording apparatus includes a recording drum 1 rotatable in a direction of arrow A in FIG. 1, with a printing plate P acting as a recording medium mounted peripherally of the drum 1, a recording head 12 for recording images on the printing plate P mounted on the recording drum 11, a transport unit 13 for transporting the printing plate P to the recording drum 11 and discharging the printing plate P from the recording drum 11, a punch unit 14 for punching positioning holes in the printing plate P transported from the transport unit 13 toward the recording drum 11, a clamp unit 17 for opening and closing forward end clamps 15 and rear end clamps 16 arranged peripherally of the recording drum 11, and moving the rear end clamps 16 along the peripheral surface of the recording drum 11, and a first and a second sensors 21 and 22.

The recording head 12 opposed to the recording drum 11 has numerous laser diodes not shown. The recording head 12 records a two-dimensional image on the printing plate P mounted peripherally of the recording drum 11, by emitting laser light according to image signals outputted from an exposure controller described hereinafter, while moving axially of the recording drum 11 (i.e. directions perpendicular to the plane of FIG. 1) synchronously with rotation of the recording drum 11.

The transport unit 13 disposed above the recording drum 11 is tiltable as indicated by an arrow B in FIG. 1, and defines therein a transport path 18 for transporting the printing plate P to the recording drum 11 and a transport path 19 for discharging the printing plate P.

The clamp unit 17 is rockable as indicated by an arrow C in FIG. 1, and has a clamp controller disposed at a distal end thereof for opening and closing the forward end clamps 15 and rear end clamps 16 arranged peripherally of the recording drum 11. The rear end clamps 16 are movable along grooves 30 formed in the peripheral surface of the recording drum 11 as described hereinafter. The clamp unit 17 also performs an operation to move the rear end clamps 16.

Figure 2:
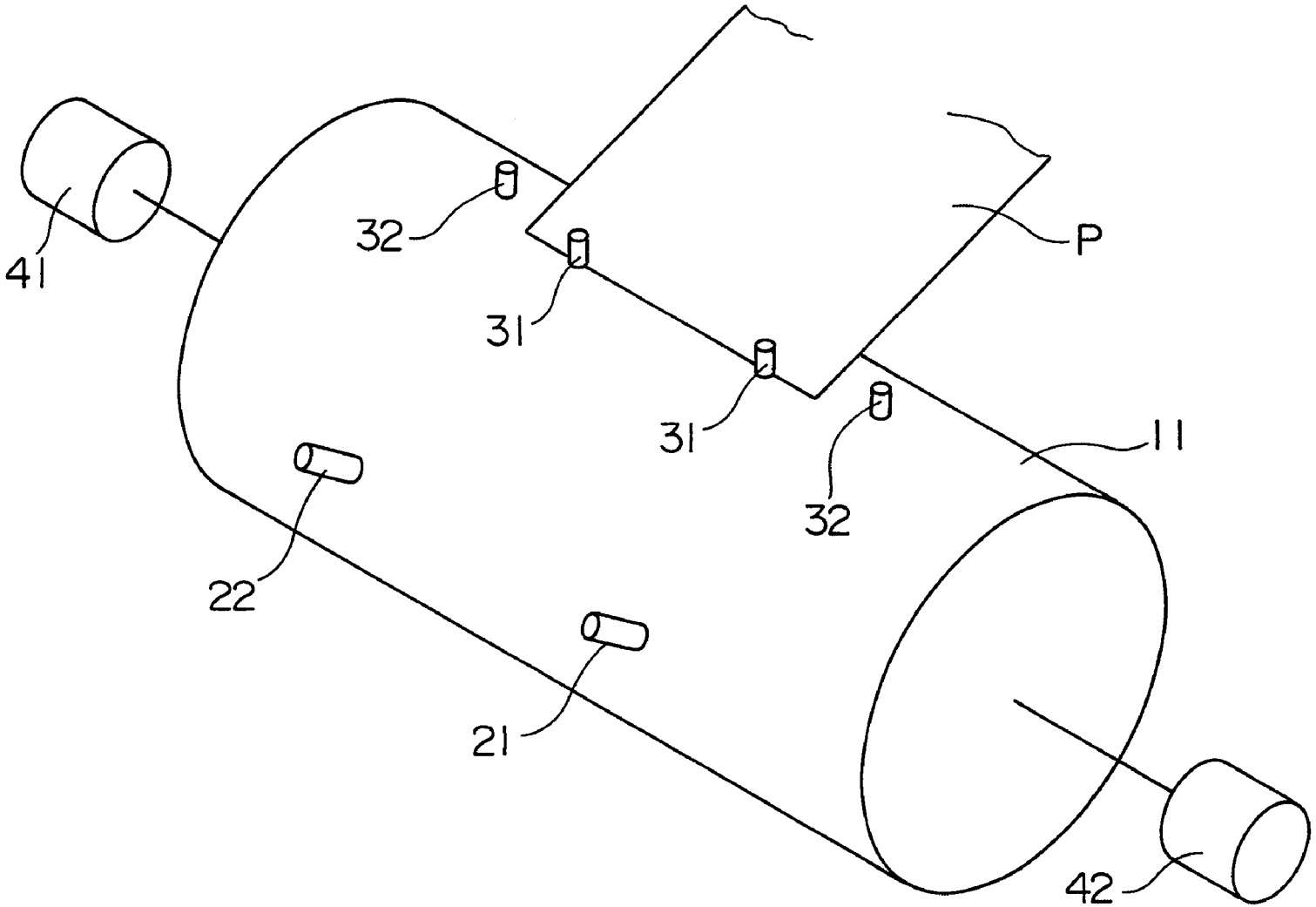
FIG. 2 is a perspective view schematically showing a recording drum and adjacent components.

FIG. 2 is a perspective view schematically showing the recording drum 11 and adjacent components. The clamps, transport unit 13 and so on are omitted from this figure. Positioning pins and the like are depicted with exaggeration.

As shown, the first and second sensors 21 and 22 are arranged in positions spaced apart by a predetermined distance axially of the recording drum 11. The recording drum 11 has two pairs of positioning pins 31 and 32 erected thereon for positioning the printing plate P by contacting positioning formed at the forward end of the printing plate P. The recording drum 11 is connected to a motor 41 and a rotary encoder 42.

Figure 3:
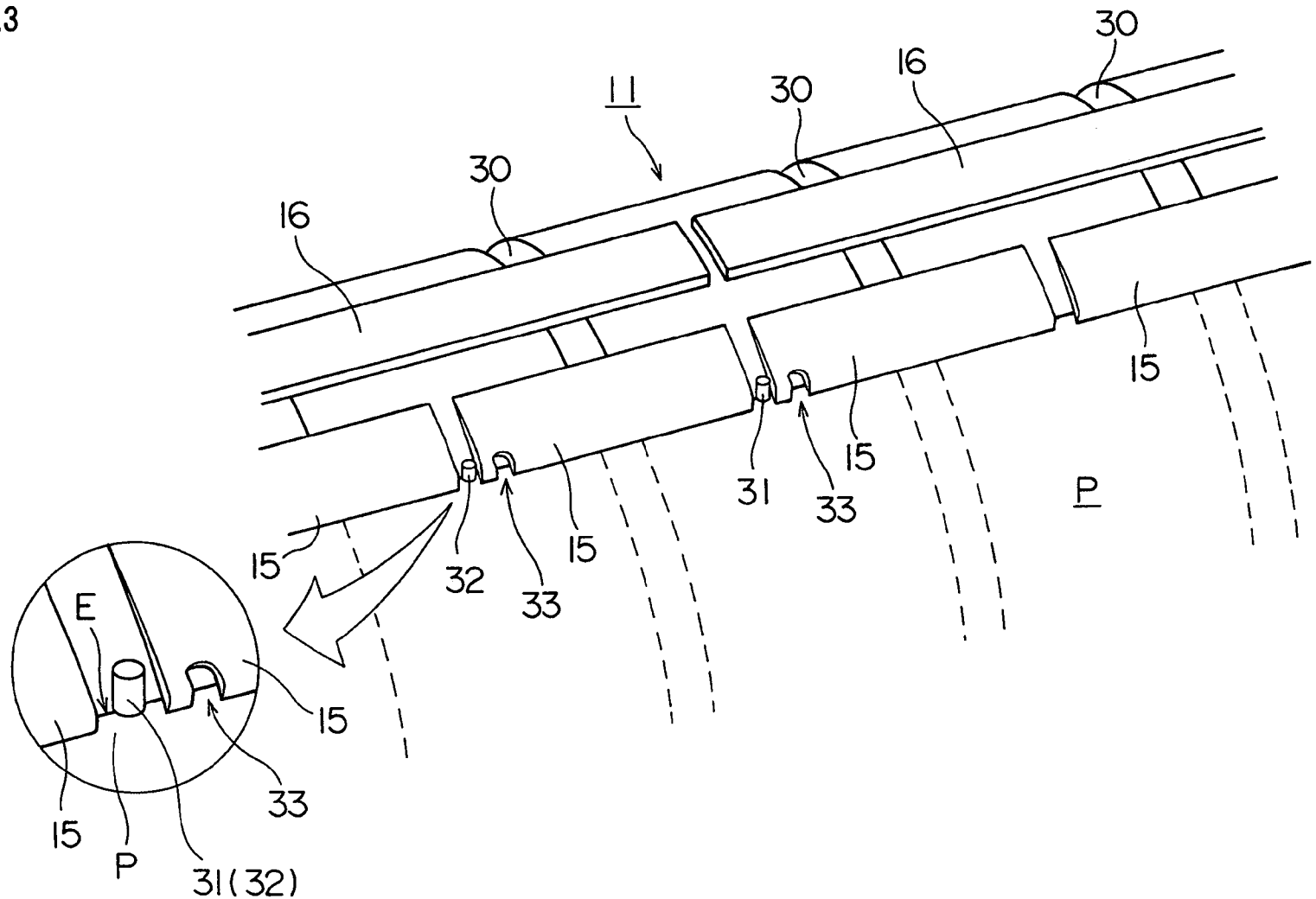
FIG. 3 is a perspective view showing a peripheral portion of the recording drum.

FIG. 3 is a perspective view showing a peripheral portion of the recording drum 11.

The peripheral portion of the recording drum 11 includes the plurality of forward end clamps 15 for clamping and fixing the forward end of the printing plate P, and the plurality of rear end clamps 16 for clamping and fixing the rear end of the printing plate P. To cope with a different size of the printing plate P, the rear end clamps 16 are movable along the grooves 30 formed in the peripheral surface of the recording drum 11, i.e. attachable to and detachable from selected positions in the grooves 30 circumferentially of the recording drum 11.

The forward end clamps 15 have detection bores 33 formed in positions thereof adjacent the positioning pins 31 and 32. Parts of an edge E of the printing plate P clamped by the forward end clamps 15 are located in these detection bores 33. The first and second sensors 21 and 22 are arranged to detect, through the detection bores 33, the edge E of the printing plate P located in the detection bores 33.

Figure 4:
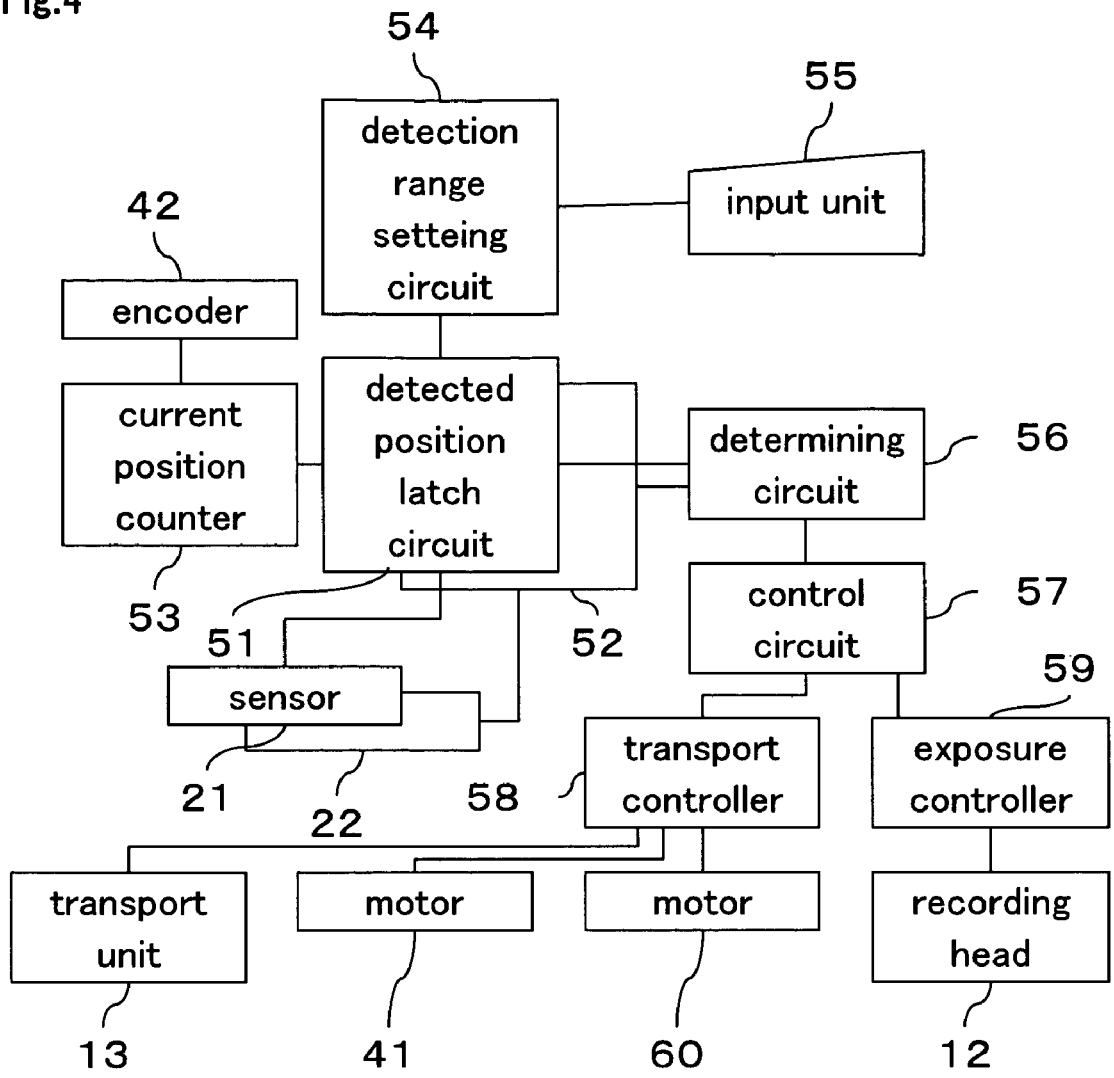
FIG. 4 is a block diagram showing a principal electrical structure of the image recording apparatus according to this invention.

FIG. 4 is a block diagram showing a principal electrical structure of the image recording apparatus according to this invention.

A current position counter 53 counts pulse signals outputted from the rotary encoder 42 connected to the recording drum 11. The current position counter 53 is connected to a pair of detected position latch circuits 51 and 52. The detected position latch circuits 51 and 52 latch counts of the current position counter 53 when the first and second sensors 21 and 22 detect the edge E of the printing plate P in a range of detection set by a detection range setting circuit 54 based on input data from an input unit 55.

The detected position latch circuit 51 is connected to a determining circuit 56 that operates the latch circuit 51 and fetches the latched count therefrom to determine the position of the edge E of the printing plate P. This determining circuit 56 is connected to a control circuit 57 that controls an image recording operation of the image recording apparatus. The control circuit 57 is connected to a transport controller 58 and an exposure controller 59. The transport controller 58 is connected to the transport unit 13 shown in FIG. 1, the motor 41 for rotating the recording drum 11 shown in FIG. 2, and a motor 60 (not shown in FIG. 1) for moving the recording head 12 axially of the recording drum 11 (in the directions perpendicular to the plane of FIG. 1). The exposure controller 59 is connected to the recording head 12.

In such image recording apparatus, the printing plate P may be mounted in a position slightly displaced circumferentially of the recording drum 11 due to various causes, or may be at a slightly varied angle to the axis of the recording drum 11.

Figure 5A:
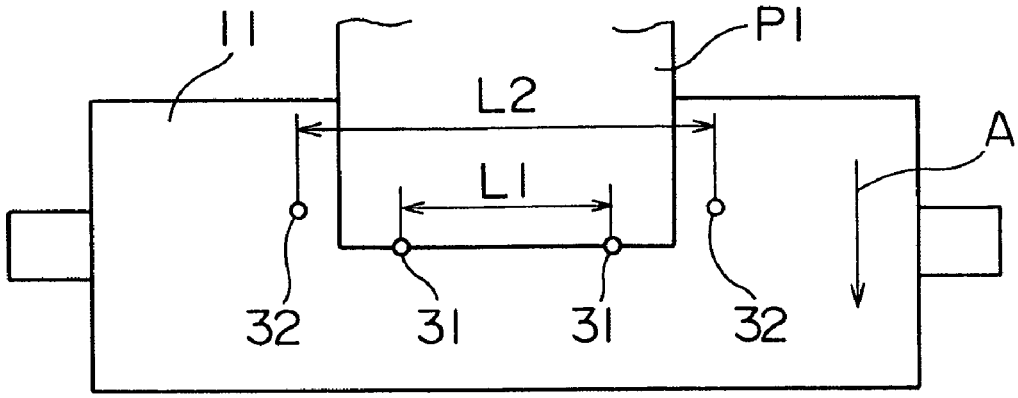
FIGS. 5A-5C are an explanatory view schematically showing states of positioning printing plates with positioning pins.
Figure 5B:
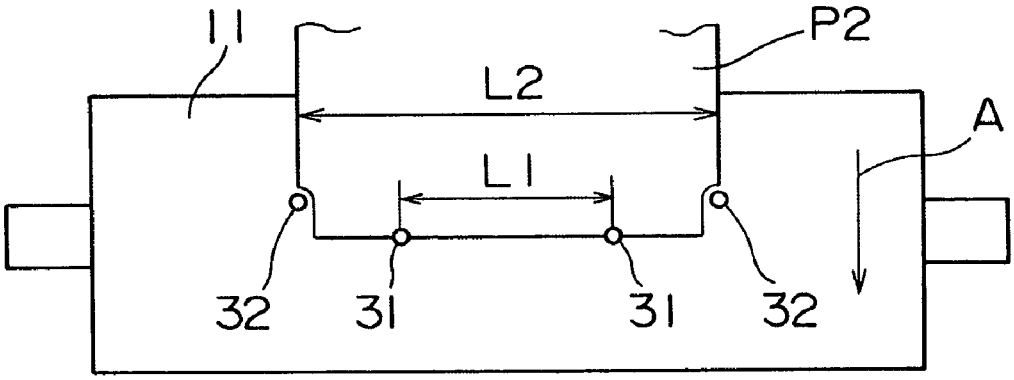
Figure 5C:
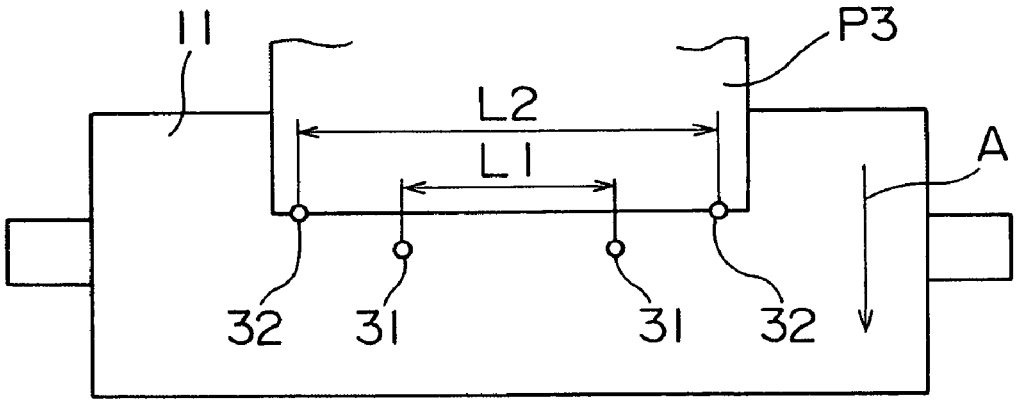

FIG. 5 is an explanatory view schematically showing states of positioning printing plates P with the positioning pins 31 and 32. The pair of positioning pins 31 are located forward of the pair of positioning pins 32 with respect to the direction of rotation A of the recording drum 11 in time of attaching the printing plates P.

As shown in FIG. 5(*a*), where the positioning pins 31 have an interval L1 therebetween and the positioning pins 32 an interval L2, a printing plate P1 with a width larger than L1 and smaller than L2 is positioned by using the inner pair of positioning pins 31. As shown in FIG. 5(*b*), a printing plate P2 with a width nearly equal to L2 is also positioned by using the inner pair of positioning pins 31 with receiving bores formed in regions of the printing plate P2 engageable with the outer pair of positioning pins 32. However, a printing plate P3 with a width larger than L2, as shown in FIG. 5(*c*), is positioned by using the outer pair of positioning pins 32. Thus, the printing plate P1 or P2 has an edge E located on a straight line extending through the centers of the inner positioning pins 31. The printing plate P3 has an edge E located on a straight line extending through the centers of the outer positioning pins 32. The edge E of the printing plate P is located further forward in the direction of rotation A of the recording drum 11 when the printing plate P1 or P2 with a width smaller than or nearly equal to L2 is used, than when the printing plate P3 with a width larger than L2 is used.

Therefore, a range of detection J by the first and second sensors 21 and 22 and an estimated position E to be described hereinafter are set further forward in the direction of rotation A of the recording drum 11 when attaching the printing plate P1 or P2 to the recording drum 11 than when attaching the printing plate P3.

With the printing plate P different in material, the edge E could be placed in a different position owing to an amount of deformation occurring when the edge E contacts the positioning pins 31 and 32. In this case, the range of detection J and estimated position E to be described hereinafter are shifted forward in the direction of rotation A of the recording drum 11 according to the above amount of deformation.

Even when the edge E of the printing plate P is placed in contact with the same positioning pins 31 (32), the position of the edge E of the printing plate P is variable circumferentially of the recording drum 11, depending on whether or not holes have been punched in the edge E of the printing plate P when contacting the positioning pins 31 (32). Thus, the range of detection J and estimated position E to be described hereinafter are set further forward in the direction of rotation A of the recording drum 11 when holes are punched than when no holes are punched.

Further, the position of the edge E of the printing plate P may vary circumferentially of the recording drum 11, depending also on the type of holes punched. Thus, the range of detection J and estimated position E to be described hereinafter are shifted forward in the direction of rotation A of the recording drum 11 according to the distance between the edge E and the tops of the holes punched in the printing plate P.

The mounting angle to the recording drum 11 of the printing plate P may be adjusted according to variations in the recording resolution of the recording head 12 (see to Unexamined Japanese Patent Publication No. 2003-337429). This measure sets recorded images parallel to the printing plate P even when the width of scanning lines changes with variations in the recording resolution.

Thus, when the mounting angle of the printing plate P is adjusted according to variations in the recording resolution, the range of detection by the first sensor 21 and the range of detection by the second sensor 22 are differentiated circumferentially of the recording drum 11 according to an angle of inclination of the edge E of the printing plate P. Estimated positions to be detected by the first and second sensors 21 and 22 are set separately and individually by taking the angle of inclination of the edge E into consideration. In such image recording apparatus, the position of the edge E of the printing plate P detected by the first and second sensors 21 and 22 may slightly vary circumferentially of the recording drum 11 according to the reflectance of the printing plate P.

The first and second sensors 21 and 22 are reflection type photosensors that emit spot beams to an object and detect light reflected from the object. The first and second sensors 21 and 22 output ON signals when the reflected light reaches a quantity at a predetermined detection level.

Where printing plates P of various materials are mounted on the recording drum 11, it is conceivable that reflectance to the wavelength of the spot beam also differs from printing plate P to printing plate P. In this case, the position of the edge E detected by the first and second sensors 21 and 22 could be displaced circumferentially of the recording drum 11. When, for example, the printing plate P has a low reflectance to the wavelength of the spot beam in time of detecting the edge E while rotating the recording drum 11, the sensors 21 and 22 output ON signals later than when detecting edges E of other printing plates P. In this case, the edge E of the printing plate P is detected in a position shifted forward in the direction of rotation A. Conversely, when the printing plate P has a high reflectance, ON signals are outputted earlier than when detecting other printing plates P. In this case, the edge E is detected in a position shifted backward in the direction of rotation A. In this way, owing to a difference in the reflectance of the printing plate P, the position of the edge E detected by the sensors 21 and 22 is variable circumferentially of the recording drum 11.

Thus, when a printing plate P of low reflectance is mounted on the recording drum 11, the range of detection by the first and second sensors 21 and 22 and the estimated position are shifted slightly backward in the direction of rotation A of the recording drum 11.

Conversely, when a printing plate P of high reflectance is mounted on the recording drum 11, the range of detection by the first and second sensors 21 and 22 and the estimated position are shifted slightly forward in the direction of rotation A of the recording drum 11.

In the image recording apparatus according to this invention, therefore, the range of detection by the first and second sensors 21 and 22 and the estimated position where the edge of the printing plate P is detected, with respect to a rotation angle of the recording drum 11, are set by using information on the material of the printing plate P, information on the reflectance of the printing plate P, and the presence or absence and type of positioning holes. The position of the edge of the printing plate P is determined based on the range of detection and estimated position.

Figure 6:
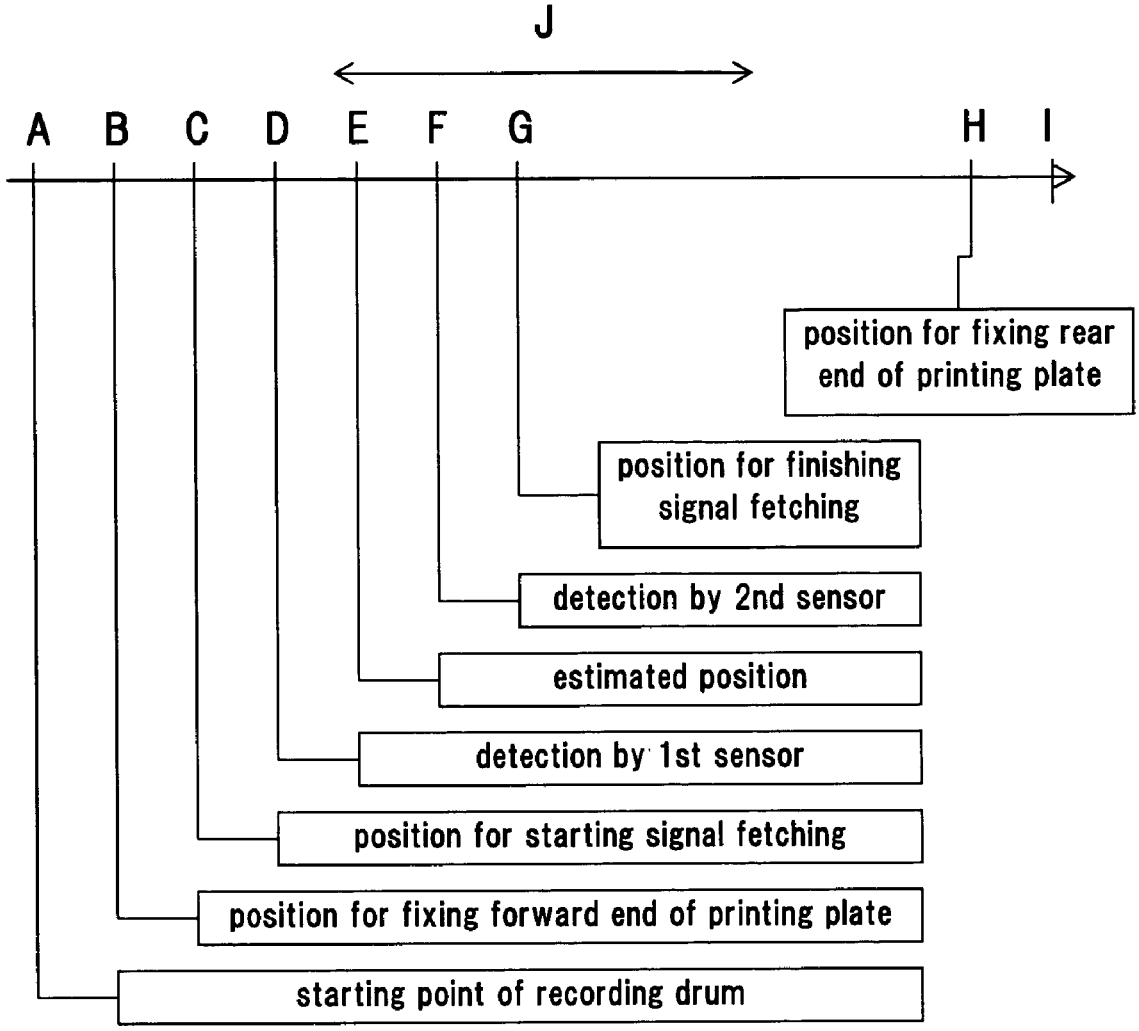
FIG. 6 is an explanatory view showing various positions corresponding to rotation angles of the recording drum.

FIG. 6 is an explanatory view showing various positions corresponding to rotation angles of the recording drum 11. The horizontal axis in FIG. 6 represents the rotation angles of the recording drum 11.

Reference A in FIG. 6 denotes a starting point of the recording drum 11 where its rotation angle is zero. In this position, the number of pulses outputted from the current position counter 53 shown in FIG. 4 is zero. Reference B denotes a rotation angle of the recording drum 11 where the forward end clamps 15 clamp the forward end of the printing plate P.

Reference C in FIG. 6 denotes a position where the detected position latch circuits 51 and 52 shown in FIG. 4 start an operation to fetch signals from the first and second sensors 51 and 52 detecting the edge E of the printing plate P, and latch counts from the current position counter 53. Reference G denotes a position for ending this operation. That is, as long as the rotation angles of the recording drum 11 are in the range of detection J from reference C to reference G in FIG. 6, the detected position latch circuits 51 and 52 latch the counts from the current position counter 53 when the first and second sensors 51 and 52 detect the edge E of the printing plate P. This range of detection J is set by the detection range setting circuit 54 using information on the material of the printing plate P, information on the reflectance of the printing plate P and the presence or absence and the type of positioning holes formed in the printing plate P, inputted through the input unit 55.

Reference E in FIG. 6 denotes the estimated position where the edge of the printing plate P is likely to be detected by the first and second sensors 21 and 22. This estimated position E also is set by the detection range setting circuit 54 using the information on the material of the printing plate P, information on the reflectance of the printing plate P, and the presence or absence and the type of positioning holes formed in the printing plate P.

Reference H in FIG. 6 denotes a position where the rear end clamps 16 clamp the rear end of the printing plate P. Reference I denotes a position where the recording drum 11 has rotated 360 degrees and returned to the starting point. The current position counter 53 outputs about 8,000 pulses, i.e. four times 2,000 pulses, to the detected position latch circuits 51 and 52 while the recording drums 11 rotates 360 degrees.

Figure 7:
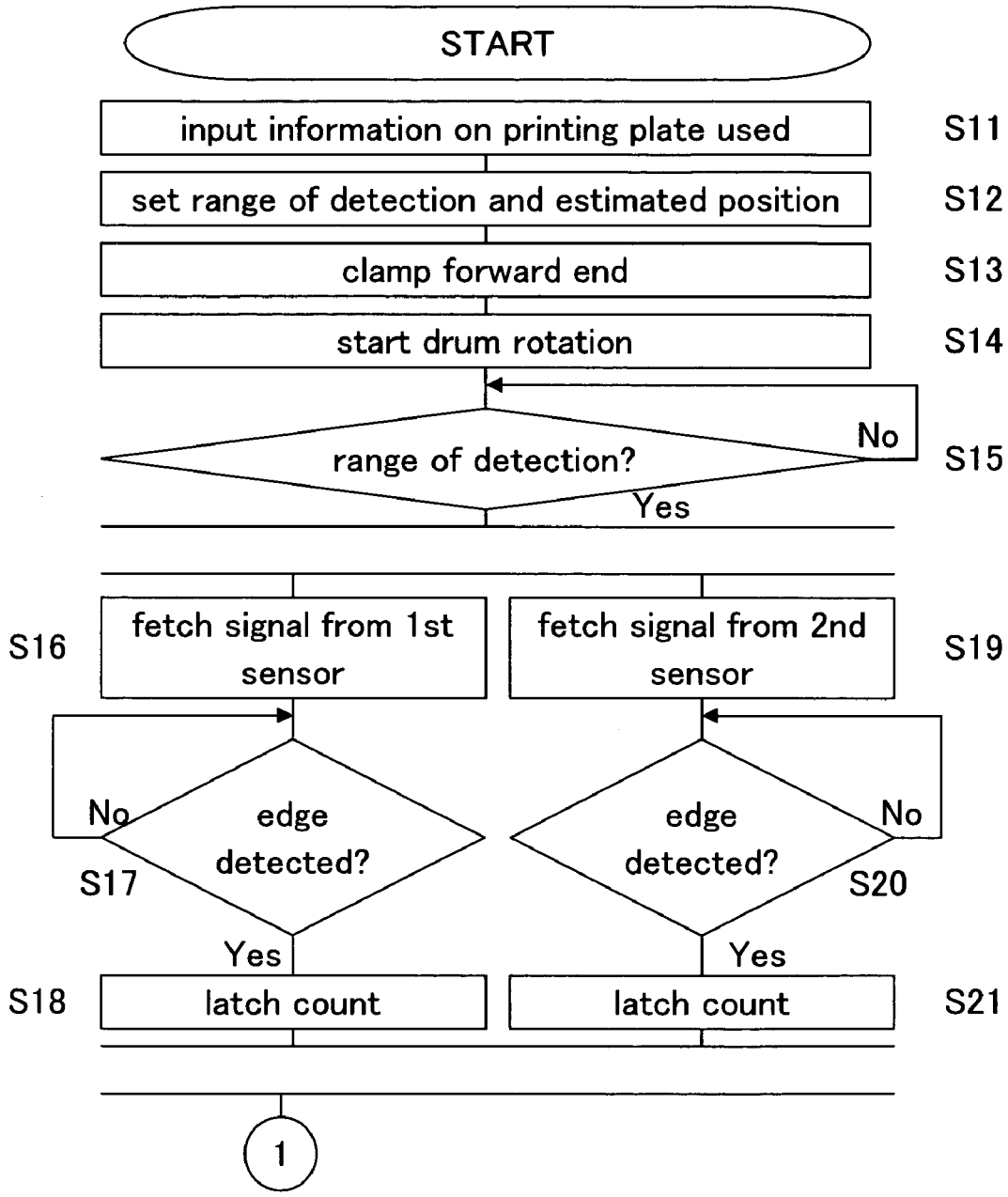
FIG. 7 is a flow chart of operation up to an image recording stage of the image recording apparatus according to this invention.
Figure 8:
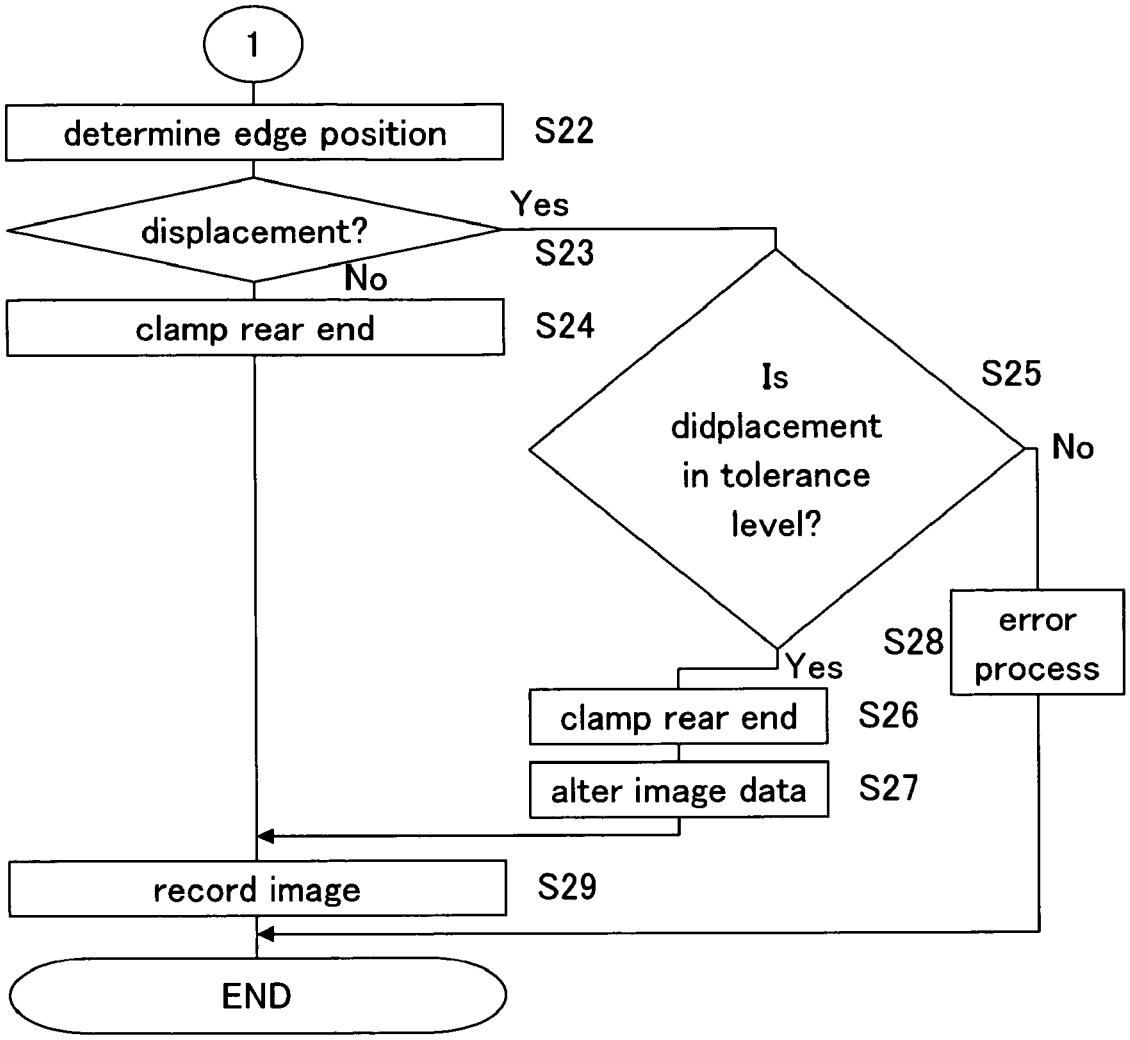
FIG. 8 is a flow chart of operation up to the image recording stage of the image recording apparatus according to this invention.

Next, operation up to an image recording stage in the image recording apparatus according to this invention will be described. FIGS. 7 and 8 show a flow chart of operation up to an image recording stage in the image recording apparatus according to this invention.

First, information on a printing plate to be used is inputted (Step S11). The information on the printing plate includes information on the material of the printing plate P, information on the reflectance of the printing plate P, and information on the presence or absence and the type of positioning holes formed in the printing plate P. This information on the printing plate P is inputted from the input unit 55 shown in FIG. 4.

Next, a range of detection (range of detection J shown in FIG. 6) by the first and second sensors 21 and 22 and an estimated position (estimated position E shown in FIG. 6) where the edge of the printing plate P is likely to be detected are set in relation to rotation angles of the recording drum 11 (step S12). These settings are made by the detection range setting circuit 54 using the information inputted from the input unit 55 such as information on the material of the printing plate P, information on the reflectance of the printing plate P, and information on the presence or absence and the type of positioning holes formed in the printing plate P.

Next, the transport unit 13 shown in FIG. 1 transports the printing plate P, the punch unit 14 punches positioning holes in the plate P, then the forward end of the plate P is advanced to a peripheral position of the recording drum 11, and the forward end clamps 15 clamp the forward end (step S13). Then, the recording drum 11 starts rotating (step S14).

When the rotation angle of the recording drum 11 reaches the position for starting signal fetching C shown in FIG. 6, and enters the predetermined range of detection J (step S15), the detected position latch circuit 51 starts fetching signals from the first sensor 21 (step S16). The operation waits for the first sensor 21 to detect the edge E of the printing plate P (step S17). When the first sensor 21 detects the edge E of the printing plate P, the detected position latch circuit 51 latches a count of the current position counter 53 (step S18).

The following steps are taken in parallel with steps S16 through S18. When the recording drum 11 enters the range of detection J set beforehand (step S15), the detected position latch circuit 52 starts fetching signals from the second sensor 22 (step S19). The operation waits for the second sensor 22 to detect the edge E of the printing plate P (step S20). When the second sensor 22 detects the edge E of the printing plate P, the detected position latch circuit 52 latches a count of the current position counter 53 (step S21).

The above steps S16 through step S18 and steps S19 through S21 are executed in parallel. In this embodiment, when the first and second sensors 21 and 22 detect the edge E of the printing plate P, the detected position latch circuits 51 and 52 latch counts of the current position counter 53. This construction provides an improvement in count detecting accuracy over the case of reading counts of the current position counter 53 at fixed intervals.

FIG. 6 shows a case in which the first sensor 21 detects the edge E of the printing plate P before the rotation angle of the recording drum 11 reaches the estimated position E, and the second sensor 22 detects the edge E of the printing plate P after the rotation angle of the recording drum 11 reaches the estimated position E. When the rotation angle of the recording drum 11 departs from the range of detection J set beforehand, the signal fetching from the first and second sensors 21 and 22 is stopped.

Referring to FIGS. 7 and 8 again, the position of the edge E of the printing plate P mounted peripherally of the recording drum 11 is determined based on the two counts latched by the detected position latch circuits 51 and 52 (step S22). This determination is made by the determining circuit 56 shown in FIG. 4. In time of this determination, the position of the edge E of the printing plate P (i.e. the position of the edge E circumferentially of the recording drum 11) and its inclination (i.e. inclination of the edge E to the axis of the recording drum 11) are determined based on position $\alpha 1$ of the edge of the printing plate P obtained from the signals of the first sensor 21 and position $\alpha 2$ of the edge of the printing plate P obtained from the signals of the second sensor 22.

Next, the estimated position set beforehand (estimated position E in FIG. 5) is compared with positions $\alpha 1$ and $\alpha 2$ to determine whether a displacement has occurred or not (step S23). When differences between the estimated position and positions $\alpha 1$ and $\alpha 2$ are both within a predetermined range, the recording drum 11 is further rotated for the rear end clamps 16 to clamp the rear end of the printing plate P (step S24). Then, the recording drum 11 is rotated at high speed for the recording head 12 to record an image (step S29).

When the difference between the estimated position E and one of positions $\alpha 1$ and $\alpha 2$ is beyond the predetermined range, a determination is made whether the error is in a tolerance level and can be corrected in an image data altering step described hereinafter (step S25).

When it is determined that the error exceeds the tolerance level, an error handling process is carried out (step S28). In time of the error handling, an error message is presented on a display not shown. In the error handling process, the recording drum 11 is rotated backward, the forward end clamps 15 are opened to release the edge E of the printing plate P, and the printing plate P is passed to the discharging transport path 19 in the transport unit 13. This procedure can reduce the time required for the error handling process, compared with discharging the printing plate P after once securing the printing plate P to the peripheral surface of the recording drum 11 with the forward and rear end clamps 15 and 16. However, the processing flow may be simplified by rotating the recording drum 11 backward and discharging the printing plate P to the transport path 19 after once securing the printing plate P to the peripheral surface of the recording drum 11 as usual.

On the other hand, when the error is determined to be in tolerance level, the recording drum 11 is further rotated for the rear end clamps 16 to clamp the rear end of the printing plate P (step S26). Subsequently, image data is altered according to the displacement of the printing plate P (step S27). That is, the control circuit 57 shown in FIG. 4 corrects the position and inclination of the image to be recorded on the printing plate P by the recording head 12, based on the position and inclination of the edge E of the printing plate P obtained from the positions $\alpha 1$ and $\alpha 2$ of the edge of the printing plate P. Then, under control of the transport controller 58 and exposure controller 59, while rotating the recording drum 11 at high speed, the printing plate P is irradiated with light beams such as laser beams emitted, according to image signals based on the corrected image data, from the recording head 12 moved in sub-scanning directions by the motor 60, thereby recording a two-dimensional image on the printing plate P (step S29).

This embodiment provides two sensors for detecting an amount of inclination of the edge E of the printing plate P. Only one sensor is sufficient where there is no need to detect inclination of the edge E. In this case, the sensor should desirably be set opposite an axially middle position in a plate mounting region on the peripheral surface of the recording drum 11.

In the above embodiment, the range of detection J by the first and second sensors 21 and 22 and the estimated position E are set based on the information on the printing plate P. However, when, as described hereinbefore, the printing plate P is mounted on the recording drum 11 as inclined according to the recording resolution of the recording head 12, the range of detection J by the first and second sensors 21 and 22 and the estimated position E may be set according to an amount of inclination.

In the above embodiment, the first and second sensors 21 and 22 detect the edge E based on a difference between the peripheral surface of the recording drum 11 and the printing plates P in the reflectance to the wavelength of the spot beams emitted from the sensors 21 and 22. However, instead of such reflection type photosensors, transmission type photosensors, digital cameras or actuator sensors may be used to detect the edge E.

Further, in the above embodiment, the edge E of the printing plate P movable with rotation of the recording drum 11 is detected by the first and second sensors 21 and 22 fixed outside the recording drum 11. Thus, in order for the first and second sensors 21 and 22 to detect the edge E of the printing plate P, it is necessary to rotate the recording drum 11 a predetermined amount in the direction of arrow A after the printing plate P is fixed by the forward end clamps 15. However, the position of edge E is detectable as long as a change occurs in the relative position between the first and second sensors 21 and 22 and the edge E. Thus, the position of the edge E of the printing plate P may be detected by moving the first and second sensors 21 and 22 circumferentially of the recording drum 11 maintained still. With this arrangement, the position of the edge E of the printing plate P may be detected by the sensors 21 and 22 immediately after the printing plate P is fixed by the forward end clamps 15. That is, the position of the edge E of the printing plate P may be detected without rotating the recording drum 11 after the printing plate P is fixed by the forward end clamps 15. In this case, the position of the edge E of the printing plate P is detected based on an amount of movement of the sensors 21 and 22.

In the described embodiment, the first and second sensors 21 and 22, preferably, are arranged in a position immediately following the position where the forward end clamps 15 are driven by the clamp unit 17. This arrangement enables checking a state of the forward end clamps 15 fixing the printing plate P only partly protruded from the transport path 18. Then, even when an error should be found, the printing plate P could be retracted into the transport path 18 of the transport unit 13 immediately.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2004-131469 filed in the Japanese Patent Office on Apr. 27, 2004, the entire disclosure of which is incorporated herein by reference.

What is claimed is:

1. An image recording apparatus comprising:

a recording drum rotatable with a recording medium mounted peripherally thereof;

a recording head for recording an image on said recording medium mounted on said recording drum by emitting light beams according to image signals to said recording medium;

a rotation angle detecting device for detecting a rotation angle of said recording drum;

a sensor device for detecting said recording medium mounted on said recording drum;

a detection range setting device for setting a range of detection of said recording medium by said sensor device with respect to said rotation angle of said recording drum, wherein at least one of information on said recording medium and a recording resolution of the image recorded by said recording head is used to shift and set said range of detection in the rotation direction of said recording drum in order to correspond to the recording medium and/or recording resolution to be used; and a determining device for determining a position of an edge of the recording medium mounted on said recording drum, by fetching signals from said sensor device based on the rotation angle of said recording drum detected by said rotation angle detecting device and the range of detection set by said detection range setting device.

2. An image recording apparatus as defined in claim 1, wherein said sensor device includes a plurality of sensors arranged in positions spaced apart axially of said recording drum.

3. An image recording apparatus as defined in claim 1, wherein said information on said recording medium includes at least one of information on a material of said recording medium, information on reflectance of said recording medium, and presence or absence and a type of positioning holes formed in said recording medium.

4. An image recording apparatus as defined in claim 1, wherein:

said rotation angle detecting device includes:

an encoder connected to said recording drum; and a counter for counting pulse signals outputted from said encoder; and said determining device includes a latch circuit for latching a count of said counter when said sensor device detects the edge of the recording medium mounted on the recording drum.

5. An image recording apparatus as defined in claim 1, wherein:

said recording drum includes:

positioning pins for positioning the recording medium on a peripheral surface of the drum; and clamps for clamping the edge of said recording medium;

said sensor device detecting the edge of said recording medium through detection holes formed in said clamps adjacent said positioning pins.

6. An image recording apparatus as defined in claim 1, wherein an error handling process is carried out when it is determined from a result of determination by said determining device that said recording medium is mounted in an improper position.

7. An image recording apparatus as defined in claim 1, wherein a position for recording the image on the recording medium by said recording head is altered based on a result of determination by said determining device.

8. An image recording apparatus as defined in claim 1, wherein said detection range setting device sets the range of detection to be further forward in a recording medium of high reflectance than a recording medium of low reflectance in the rotation direction.

9. An image recording apparatus as defined in claim 1, wherein said detection range setting device sets the range of detection to be further forward in a recording medium provided with positioning holes than a recording medium without positioning holes in the rotation direction.

10. An image recording apparatus comprising:

a recording drum rotatable with a recording medium mounted peripherally thereof;

a recording head for recording an image on said recording medium mounted on said recording drum by emitting light beams according to image signals to said recording medium;

a rotation angle detecting device for detecting a rotation angle of said recording drum;

a sensor device for detecting said recording medium mounted on said recording drum;

an estimated position setting device for setting an estimated position in which the edge of the recording medium is likely to be detected with respect to said rotation angle of said recording drum, wherein at least one of information on said recording medium and a recording resolution of the image recorded by said recording head is used to shift and set said estimated position in the rotation direction of said recording drum in order to correspond to the recording medium and/or recording resolution to be used; and a control circuit for determining whether said recording medium is mounted in a proper position on said recording drum, based on a position of the edge of the recording medium detected from signals of said sensor device and the estimated position of the edge of the recording medium set by said estimated position setting device.

11. An image recording apparatus as defined in claim 10, wherein said information on said recording medium includes at least one of information on a material of said recording medium, information on reflectance of said recording medium, and presence or absence and a type of positioning holes formed in said recording medium.

12. An image recording apparatus as defined in claim 10, wherein said sensor device includes a plurality of sensors arranged in positions spaced apart axially of said recording drum.

13. An image recording apparatus as defined in claim 10, wherein:

said rotation angle detecting device includes:

an encoder connected to said recording drum; and a counter for counting pulse signals outputted from said encoder; and said image recording apparatus further comprises a latch circuit for latching a count of said counter when said sensor device detects the edge of the recording medium mounted on the recording drum.

14. An image recording apparatus as defined in claim 10, wherein:

said recording drum includes:

positioning pins for positioning the recording medium on a peripheral surface of the drum; and clamps for clamping the edge of said recording medium;

said sensor device detecting the edge of said recording medium through detection holes formed in said clamps adjacent said positioning pins.

15. An image recording apparatus as defined in claim 10, wherein an error handling process is carried out when it is determined from a result of determination by said control circuit that said recording medium is mounted in an improper position.

16. An image recording apparatus as defined in claim 10, wherein a position for recording the image on the recording medium by said recording head is altered based on the position of the edge of the recording medium detected from the signals of said sensor device.

17. An image recording apparatus as defined in claim 10, wherein said estimated position setting device sets the estimated position to be further forward in a recording medium of high reflectance than a recording medium of low reflectance in the rotation direction.

18. An image recording apparatus as defined in claim 10, wherein said estimated position setting device sets the estimated position to be further forward in a recording medium provided with positioning holes than a recording medium without positioning holes in the rotation direction.

* * * * *